United States Patent [19]

Townsend

[11] Patent Number: 4,761,938

[45] Date of Patent: Aug. 9, 1988

[54] STIRRUP EXTENSION

[75] Inventor: Ray T. Townsend, Des Moines, Iowa

[73] Assignee: Townsend Engineering Company, Des Moines, Iowa

[21] Appl. No.: 42,662

[22] Filed: Apr. 27, 1987

[51] Int. Cl.[4] ..... B68C 3/00

[52] U.S. Cl. ..... 54/47

[58] Field of Search ..... 54/46, 47, 48

[56] References Cited

U.S. PATENT DOCUMENTS

| | | | |
|---|---|---|---|
| 706,468 | 8/1902 | Wellman | 54/47 |
| 2,935,833 | 5/1960 | Woodhead | 54/48 |

FOREIGN PATENT DOCUMENTS

| | | | |
|---|---|---|---|
| 29312 | 10/1884 | Fed. Rep. of Germany | 54/47 |
| 2258772 | 9/1975 | France | 54/47 |
| 2037139 | 7/1980 | United Kingdom | 54/47 |

*Primary Examiner*—Robert P. Swiatek

*Attorney, Agent, or Firm*—Zarley, McKee, Thomte, Voorhees & Sease

[57] ABSTRACT

A stirrup extension is disclosed comprised of an elongated frame constructed of a continuous rod. The frame has a pair of vertically disposed hooks at its upper end adapted to fit over the upper shoulder of a conventional stirrup on opposite sides of a conventional vertically disposed stirrup strap. A step is located at the lower end of the frame at a position below the elevation of the conventional stirrup step. An arm is secured to the frame and extends vertically upwardly therefrom and terminates in a horizontally disposed U-shaped hook which is adapted to engage the inner surface of the conventional stirrup strap. The arm and hook stabilize the frame and prevent its movement with respect to the stirrup and the stirrup strap as the rider steps into the frame for mounting the horse upon which the equipment is positioned.

16 Claims, 1 Drawing Sheet

STIRRUP EXTENSION

BACKGROUND OF THE INVENTION

The operational height of a stirrup often makes it difficult for a rider to step into the stirrup to mount the horse upon which a saddle and the stirrup are positioned. Some inventions have been devised to accommodate this problem such as the Woodhead U.S. Pat. No. 2,935,833 issued May 10, 1960. However, this device is complicated in construction and is not readily adaptable for use in conjunction with existing stirrups.

SUMMARY OF THE INVENTION

The device of this invention is adapted for use with conventional stirrups and is detachably secured thereto. This invention provides a structure which has the effect of extending the length of a conventional stirrup so as to provide a lower step for the rider to use.

This invention comprises a stirrup extension frame comprised of a continuous rod. A pair of vertically disposed spaced hooks are formed at the top of the frame, and these hooks are adapted to be supported on the upper shoulder of a conventional stirrup adjacent opposite sides of a conventional stirrup supporting strap. The frame extends downwardly from the pair of vertical hooks and terminates in a step portion which is located below the step portion of the conventional stirrup.

A vertically disposed arm is secured to the upper end of the stirrup extension frame. The upper end thereof terminates in a horizontally disposed latch or U-shaped hook which is adapted to engage the inside surface of the conventional stirrup strap. When the weight of the rider is imposed on the step of the frame, the hook on the upper end of the arm bears against the strap and prevents the frame from pivoting inwardly towards the side of the horse about the supporting shoulder of the conventional stirrup.

A principal object of this invention is to provide a stirrup extension device which is adaptable for use on conventional stirrups.

A further object of the invention is to provide a stirrup extension device which will not substantially pivot or move as the rider steps into the device while the horse is being mounted.

A further object of the invention is to provide a stirrup extension device which can be easily mounted on and removed from a conventional stirrup.

A still further object of this invention is to provide a stirrup extension device which is economical of manufacture, durable in use and refined in appearance.

These and other objects will be apparent to those skilled in the art.

DESCRIPTION OF THE PREFERRED EMBODIMENT

Figure 1:
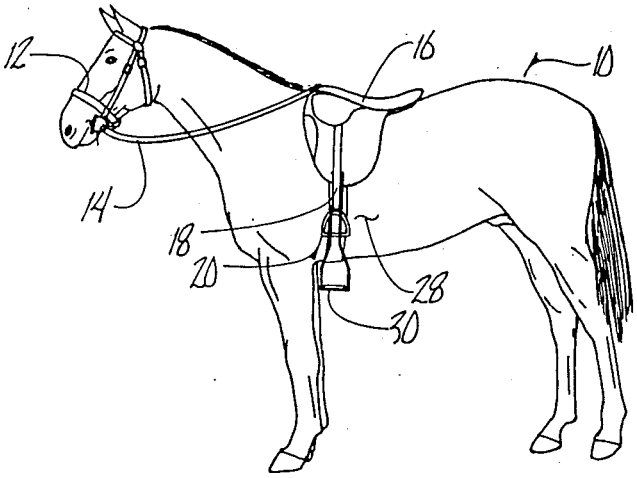
FIG. 1 is a side elevational view of a horse wherein the device of this invention is secured to the stirrup and saddle positioned on the horse.
Figure 2:
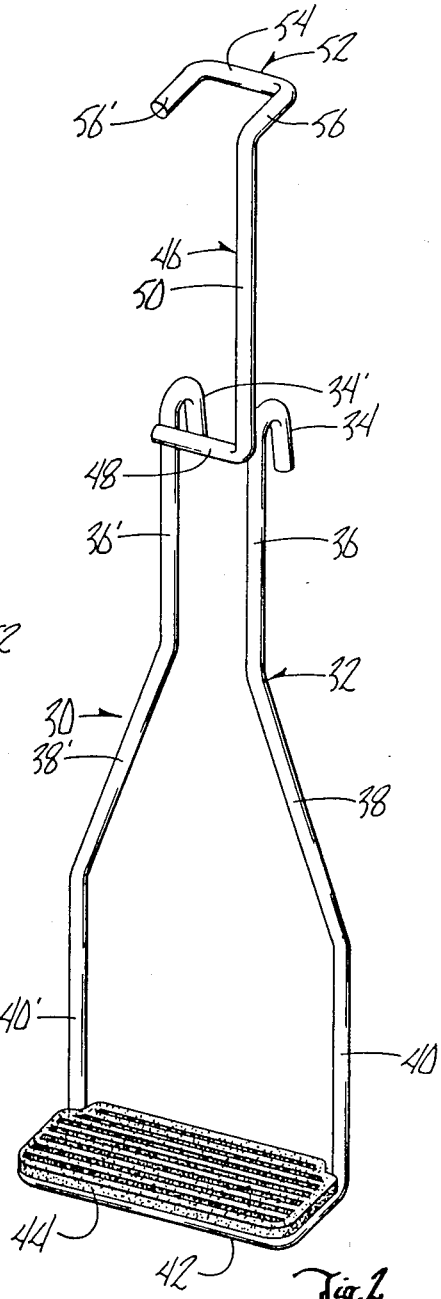
FIG. 2 is an enlarged scale perspective view of the device of this invention.

FIG. 1 shows a horse 10 with a conventional bridle 12 with reins 14. A conventional saddle 16 is positioned on horse 10. Conventional stirrup straps 18 extend downwardly from the saddle and support stirrups 20. Each stirrup 20 includes a shoulder 22 including a horizontal slot 24 through which the stirrup strap 18 is threaded. The stirrup 20 has a conventional step 26 at its lower end. The stirrup strap and stirrup are positioned as shown in FIG. 1 when the horse is not mounted wherein the strap and the stirrup lay generally against the side 28 of the horse.

The stirrup extension frame 30 of this invention is comprised of a continuous rod 32 which has vertical hook portion 34 formed at its upper end. The rod 32 then extends downwardly into vertical portion 36 from hook portion 34; thence diagonally outwardly and downwardly to form diagonal portion 38; thence downwardly to form vertical portion 40; and thence is bent to form a horizontal U-shaped portion 42 which receives a conventional stirrup step 44. The opposite side of stirrup extension frame 30 is symetrically formed from the continuous rod 32 into portions 34', 36', 38', and 40', which are symetrically shaped with respect to previously described portions 34, 36, 38, and 40, respectively.

An arm 46 formed of a continuous rod has a lower horizontal portion 48 which is welded or otherwise secured to the top of frame 30 by welding or the like. Horizontal portion 46 has one of its ends terminating in vertical portion 50 which extends upwardly from the frame 30 and terminates in a horizontal U-shaped latch or hook 52. Hook 52 includes a bight portion 54 and opposite sides 56 and 56'.

Figure 3:
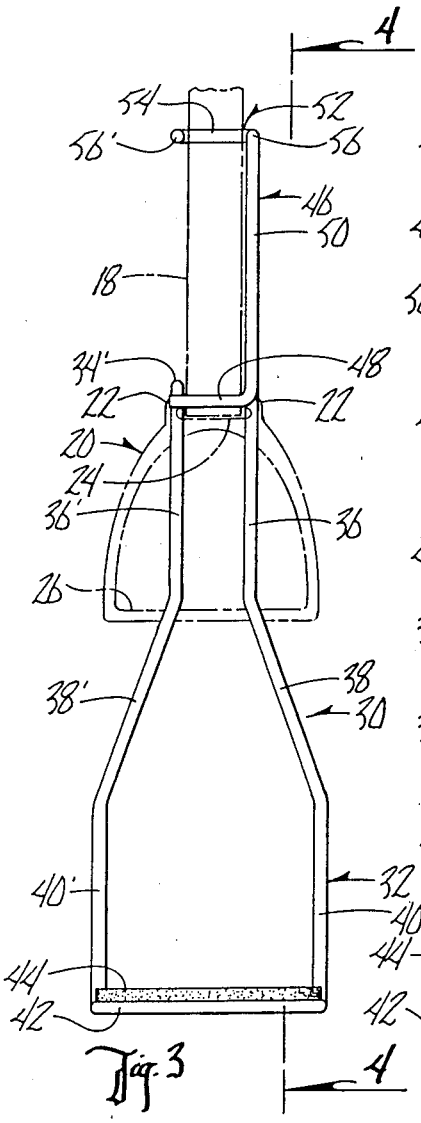
FIG. 3 is a reduced scale side elevational view thereof.
Figure 4:
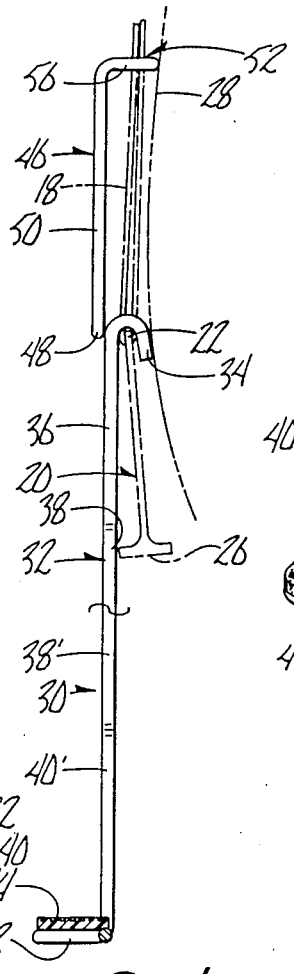
FIG. 4 is a sectional view taken on line 4—4 of FIG. 3.

In operation, the hooks 34 and 34' are placed over the shoulder 22 of stirrup 20 as best shown in FIGS. 3 and 4, so that the frame 30 dwells on the outside of stirrup 20 opposite to the side 28 of horse 10. At the same time, hook 52 is caused to engage the inside surface of strap 18 so that the bight portion 54 dwells between the strap and the side 28 of horse 10. The sides 56 and 56' of the hook 52 maintain the frame 30 in a position of vertical alignment with the strap 18 as viewed in FIG. 3. The bight portion 54 of hook 52 maintains the frame 30 in a position of vertical alignment with stirrup strap 18 when the rider steps onto the step 44. This is best seen in FIG. 4 where it is clear that the mounting force of the rider exerted upon step 44 will not cause the frame 30 to pivot about the point of engagement of hooks 34 and 34' mounted on shoulder 22 of stirrup 20. This is because the hook 52, by engaging the inside surface of the strap, will prevent any clockwise rotation of the apparatus about shoulder 22 (as viewed in FIG. 4).

Once the rider has mounted the horse 10 by utilizing the stirrup extension frame 30, the frame can be easily removed by the rider or his trainer so that it will not in any way interfere as the horse is being ridden. Since this device is adaptable for use on virtually every type of conventional stirrup, substantial savings result by not having to replace the conventional stirrups on any saddle.

Thus it is seen that the device of this invention accomplishes at least all of its stated objectives.

I claim:

1. A stirrup step extension, comprising, an elongated rigid frame means having upper and lower ends, connecting means on the upper end of said frame means adapted to releasably connect said frame means to a conventional stirrup means, step means on the lower end of said frame means, arm means having upper and lower ends and being connected by its lower end to the upper end of said frame means, and latch means on the upper end of said arm means and being adapted to releasably engage a vertical stirrup strap supporting said conventional stirrup means.

2. The device of claim 1 wherein said connecting means is a pair of downwardly extending hooks adapted to engage an upper shoulder of said conventional stirrup means at the opposite sides of said vertical stirrup strap.

3. The device of claim 2 wherein said latch means is a horizontally disposed hook means.

4. The device of claim 1 wherein said latch means is a horizontally disposed hook means.

5. The device of claim 4 wherein said arm means and said latch means are comprised of a continuous-shaped elongated rod.

6. The device of claim 4 wherein said hook means is U-shaped.

7. The device of claim 1 wherein said elongated frame means is comprised of a continuous-shaped elongated rod.

8. The device of claim 7 wherein said connecting means is a pair of downwardly extending hooks adapted to engage an upper shoulder of said conventional stirrup means at the opposite sides of said vertical stirrup strap, said hooks being positioned in parallel spaced relation, said rod comprising said hooks and then extending downwardly and outwardly, and thence comprising a loop portion to create said step means.

9. The device of claim 8 wherein said loop portion is horizontally disposed.

10. The device of claim 7 wherein said arm means and said latch means are comprised of a second continuous-shaped elongated rod.

11. The device of claim 1 wherein said conventional stirrup means includes an upper shoulder engaging said connecting means to support said frame means, and a vertical support strap secured to said upper shoulder of said stirrup means; said stirrup strap having an inside surface normally positioned adjacent the side of a horse upon which the stirrup means is being used, and an outside surface opposite the side of the horse; with said latch means engaging said inside surface of said strap to substantially maintain said frame means in a position of alignment with said strap when a rider steps into said step means.

12. The device of claim 11 wherein said latch means, by engaging said inside surface of said strap, further substantially maintains said frame means from pivoting about said connecting means.

13. The device of claim 11 wherein said connecting means is a pair of downwardly extending hooks engaging said upper shoulder of said stirrup means at opposite sides of said strap.

14. The device of claim 13 wherein said latch means is a horizontally disposed hook means.

15. The device of claim 14 wherein said hook means is U-shaped.

16. The device of claim 11 wherein said latch means is a horizontally disposed hook means.

* * * * *